United States Patent [19]

Melet

[11] Patent Number: 5,047,210

[45] Date of Patent: Sep. 10, 1991

[54] DEVICE FOR PRESENTING RECEPTACLES

[75] Inventor: François Melet, Osny, France

[73] Assignee: Melet Schloesing Laboratories, Osny, France

[21] Appl. No.: 288,609

[22] Filed: Dec. 12, 1988

[30] Foreign Application Priority Data

Dec. 4, 1987 [FR] France ..... 87 17297

[51] Int. Cl.[5] ..... B01L 9/00; A47F 5/02

[52] U.S. Cl. ..... 422/64; 422/104; 436/43; 211/71; 211/74; 211/78; 211/70; 248/131; 222/144

[58] Field of Search ..... 422/64, 102, 104; 436/47, 48; 222/144; 211/71, 74, 77, 78, 70.3, 70.4, 70; D24/31, 32; 248/131, 146

[56] References Cited

U.S. PATENT DOCUMENTS

| | | | |
|---|---|---|---|
| 15,253 | 9/1899 | Hofmann | 211/70.3 |
| 3,489,525 | 8/1967 | Natelson | 422/64 |
| 3,709,429 | 1/1973 | McKenzie et al. | 211/74 |
| 3,712,144 | 1/1973 | Kuzel et al. | 422/64 |
| 3,720,502 | 12/1970 | Gropper et al. | 422/102 |
| 4,166,094 | 8/1979 | Froehlich et al. | 422/64 |
| 4,475,411 | 10/1984 | Wellerfors | 422/64 |
| 4,479,720 | 10/1984 | Mochida et al. | 422/102 |

*Primary Examiner*—Robert J. Warden
*Assistant Examiner*—Theresa A. Trembley
*Attorney, Agent, or Firm*—Browdy and Neimark

[57] ABSTRACT

A device for presentation of receptacles containing samples of liquid with a view to transferring them to an automatic analyzer. The device comprises a cylindrical drum forming a core integral with at least two circular crowns perforated or with cavities to receive the receptacles and sloping them relative to the axis of the drum which is maintained horizontal during the presentation of the samples with a view to transferring them into the analyzer. Such a device having a small bulk enables ideal agitation as a consequence of the rotation and tipping over of the samples during their presentation.

14 Claims, 3 Drawing Sheets

DEVICE FOR PRESENTING RECEPTACLES

BACKGROUND OF THE INVENTION

The present invention relates to a device for the presentation of receptacles each containing a sample of liquid to be analysed.

DESCRIPTION OF THE PRIOR ART

In numerous industries, in particular in chemistry, in pharmacy and in medical analytical laboratories, it is necessary to perform the same analysis on a large number of samples.

These analyses are performed by an automatic apparatus in which the different samples to be analysed are introduced successively.

In order to prevent the reduction of speed of these automatic apparatuses, each receptacle containing a sample to be analyzed must be presented as rapidly as possible to the analyzer.

Conventionally, automatic sampling blood samples contained in sample tubes, has been carried out using a sample presenting device having the form of a wheel.

This wheel, the spokes of which are constituted by the assay tubes having the stoppers directed outwards, turns in such a way as to present each tube in a fixed position where a needle, driven in an alternating movement, performs the sample removal necessary for the analysis.

Such a presenting device, in addition to its bulky nature, has the disadvantage of shaking the samples too vigorously, which introduces the risk of destroying the blood cells by causing them to burst, and consequently the risk of changing the results of the analysis which may include the specification of a blood cell count.

Also known, especially from the patent U.S. Pat. No. 3,115,966, is a presenting device having the form of a rotating drum at the periphery of which assay tubes are disposed in a direction parallel to the vertical axis of rotation of the drum.

Such a device is considerably less bulky than the preceding one, but the vertical disposition of the drum and consequently of the assay tubes containing the samples to be analyzed not only favors sedimentation but also prevents any agitation of the liquids present in the tubes, which is prejudicial to good homogenization in each assay tube of the sample which is to be removed.

SUMMARY OF THE INVENTION

The object of the present invention is to overcome these disadvantages.

The present invention provides a device for the presentation of receptacles, especially of assay tubes each containing a sample of liquid to be analyzed. The said device comprises a cylindrical rotatable drum having a core and at least two circular crowns which are integral with the core, and one crown being disposed at each end of the drum, at least two of the crowns having the same number of receptacle receiving means selected from the group consisting of perforations and cavities distributed all around the respective crown and adapted to receive the receptacles containing the samples, the receptacle receiving means of the crowns being disposed in such a way that an axis of each receptacle when received in the receptacle receiving means is inclined at an acute angle less than 45° relative to an axis of rotation of the drum, and wherein, in use, the axis of rotation of the drum is maintained horizontal during the presentation of the receptacles with a view to the transfer, after homogenization, of all or part of their contents into an automatic analyser.

The device according to the invention for presentation of receptacles each containing a sample of liquid to be analyzed by an automatic analyzer comprises a cylindrical rotating drum forming a core integral with at least two circular crowns situated in planes perpendicular to the axis of rotation of the drum and disposed at each end of the drum, each of the crowns presenting the same number of perforations or cavities distributed all around their surface and adapted to receive the receptacles containing the samples to be analyzed, the said device being characterized in that the perforations or cavities of the two end crowns are disposed in such a way that the axis of each receptacle is inclined at an acute angle less than 45° relative to the axis of the drum, and in that the axis of rotation of the drum is maintained horizontal during the presentation of the receptacles in the automatic analyzer.

When such a presenting device is employed in or in association with an automatic analysis apparatus, the axis of the drum being horizontal and turning at a defined angle in such a way as to present each receptacle, equipped with a hermetically sealed stopper, successively in one and the same position where a needle, driven in an alternating movement, pierces the stopper to perform the sample removal then the transfer of all or part of the contents of the receptacle necessary for the analysis, it is established that the liquid to be analyzed is subjected to a dual agitation, due on the one hand to the rotation of the drum and, on the other hand, to the slope of the axis of each receptacle.

This dual agitation, by rotation and tipping of the receptacle, favors homogenization of the sample to be analyzed without damage as a result of its fragility, which is particularly important in the case of blood samples.

The cylindrical rotating drum of the device in accordance with the invention may optionally comprise one or a plurality of circular crowns likewise situated in a plane perpendicular to the axis of rotation of the drum, but at an intermediate level between the end crowns and presenting the same number of perforations distributed all around its surface, or their surfaces, and adapted to receive the receptacles containing the samples while guiding them from one end of the drum to the other.

The receptacles containing the samples of liquid to be analyzed and disposed at the periphery of the drum in a sloping manner relative to its axis may, according to the invention, rest on a supplementary circular end crown which is not perforated or provided with cavities, and which serves simply as a stop for the receptacles.

To maintain the receptacles inclined according to the invention, various means may be provided, especially an element for holding by friction in the perforations or cavities of a crown receiving the end of each receptacle.

The angle of slope between the lines joining the centers of the perforations or cavities receiving a receptacle and the axis of the drum is an acute angle less than 45° and preferably between 5° and 20°.

According to a first embodiment of the invention, the center of each perforation of the end circular perforated crown is aligned with the center of a perforation of the perforated intermediate crown or of the two perforated intermediate crowns in accordance with the generatrix of a cone having the same axis as that of the cylindrical drum in a manner to slope the receptacles relative to this axis.

The outer diameters of the circular crowns fixed to the drum then decrease from one end of the drum to the other.

The half-angle at the summit of the cone of revolution, the generatrix of which passes through the centers of the perforations of the circular crowns and which defines the slope of the receptacles relative to the axis of the drum, is an acute angle less than 45°, preferably between 5° and 20°.

According to a second embodiment of the invention, the centers of the perforations or the cavities of the end circular crowns, and those of the intermediate circular perforated crown or crowns, are all situated on the surface of a cylinder of revolution having the same axis as the drum but of larger diameter.

The centers of the perforations of the end circular perforated crown are not situated on the same generatrices of this cylinder of revolution as the centers of the perforations of the one intermediate crown or the intermediate crowns, and so they present the receptacles sloped relative to these generatrices.

The angle formed between the axis of the drum and the alignment of the center of a perforation of an end circular perforated ring with the center of the perforation of the one intermediate crown or the intermediate crowns closest to the generatrix of the said cylinder of revolution passing through the first center, the said angle defining the slope of the receptacles relative to the axis of the drum, is an acute angle less than 45°, preferably between 5° and 20°.

BRIEF DESCRIPTION OF THE DRAWINGS

The invention is illustrated as follows with reference to the attached drawings in which.

DETAILED DESCRIPTION OF THE PREFERRED EMBODIMENTS

Figure 1:
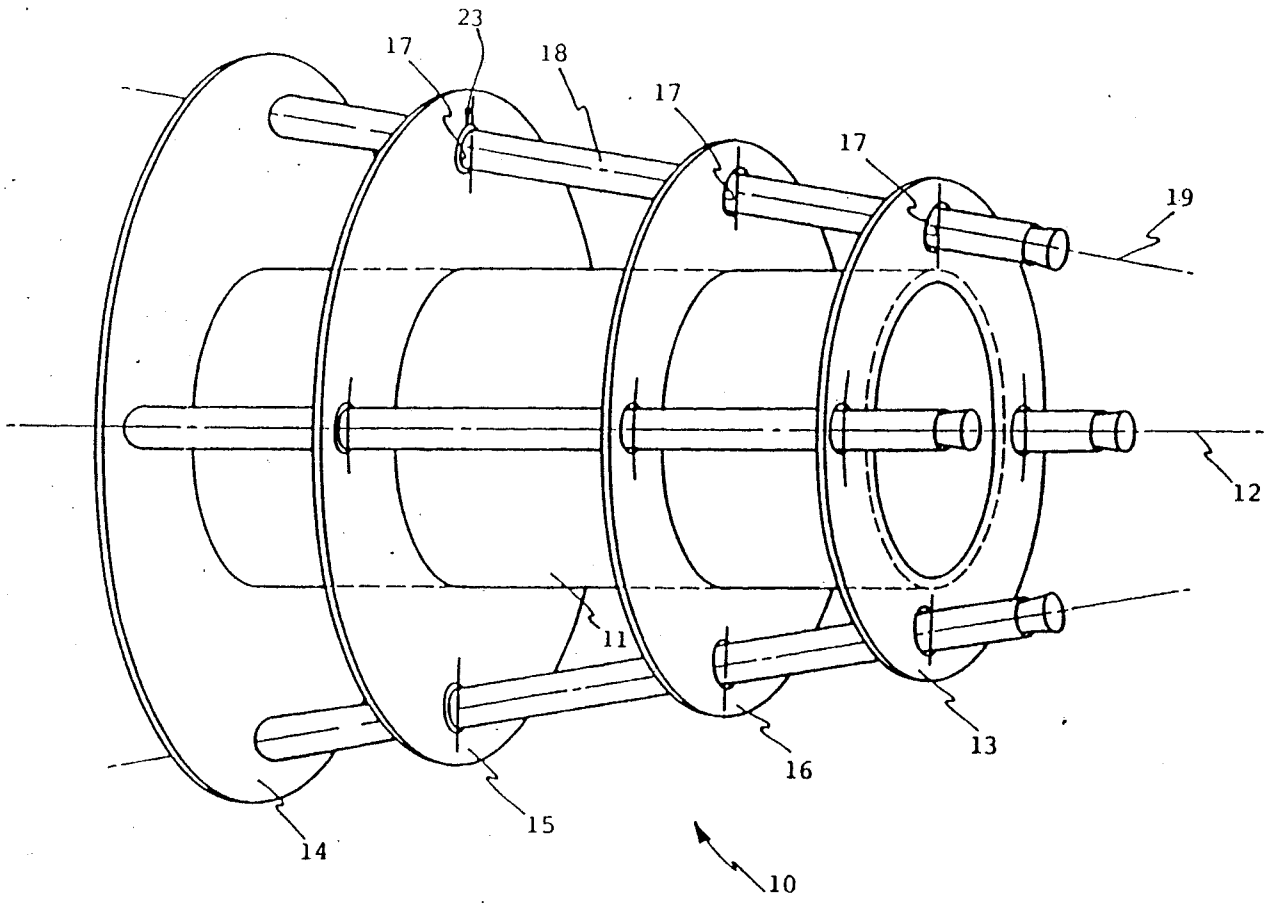
FIG. 1 shows a perspective view of a first embodiment of the device according to the invention.

The presenting device 10 according to the invention, as shown in any of the attached Figures comprises a cylindrical drum 11 in the form of a central core having an axis 12.

This drum is integral with two circular end crowns, one 13 of which is provided with perforations and the other of which 14 is not.

The drum is likewise integral with at least one intermediate circular crown 15, situated near the unperforated end crown 14, and preferably with a second intermediate circular crown 16 situated near the perforated end crown.

Each of the intermediate circular crowns 15 and 16 is provided with perforations 17 identical in number and dimensions to the perforations provided in the end crown 13.

These perforations 17 have a diameter sufficient for a receptacle 18 containing the sample of liquid to be analyzed to pass through. This receptacle is usually an assay tube and the perforations 17 are aligned from one crown to the other so that the assembled receptacles are disposed around the drum 11.

Figure 2:
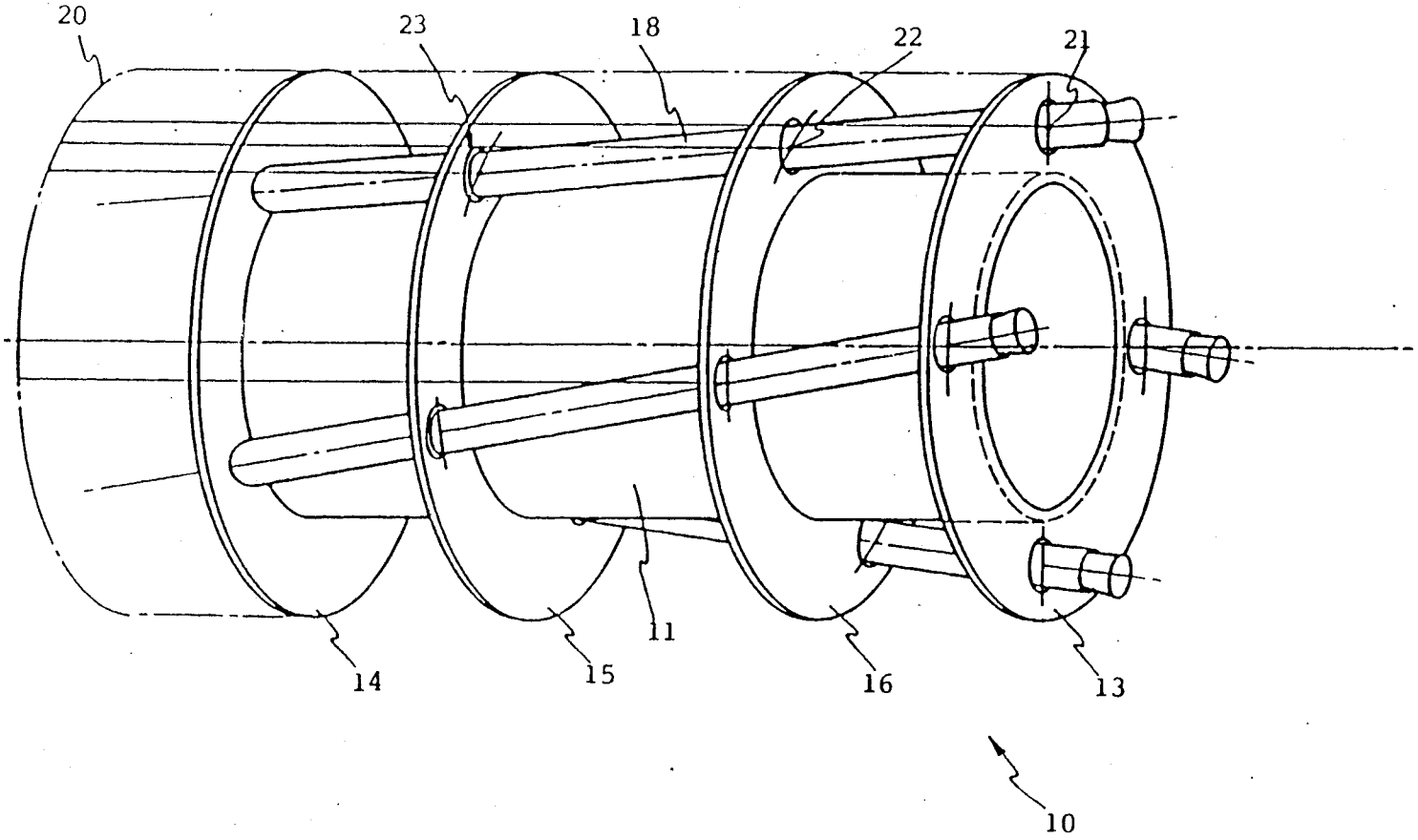
FIG. 2 shows a perspective view of a second embodiment of the device according to the invention.
Figure 3:
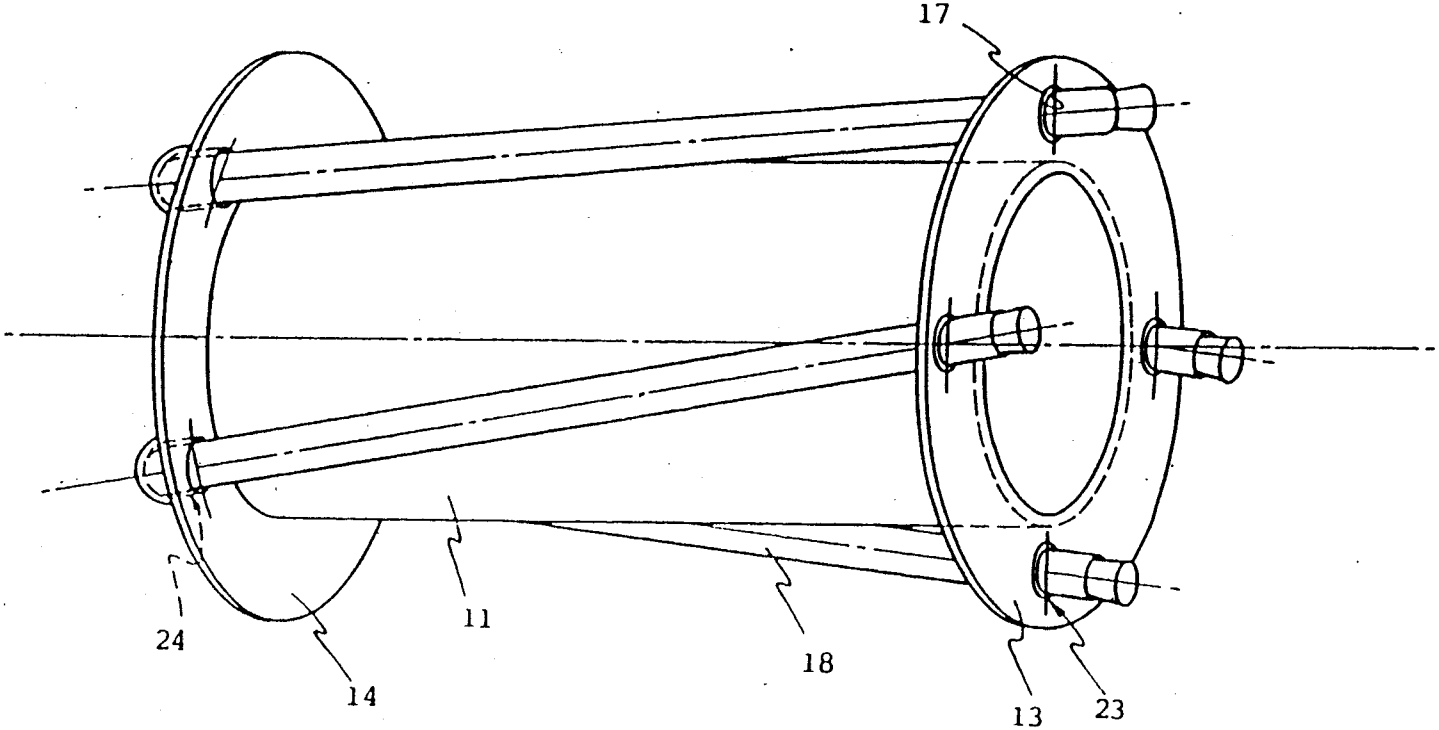
FIG. 3 shows a perspective view of a third, simplified embodiment of the device according to the invention.

Although FIGS. 1 to 3 show only the positioning of four receptacles 18 for clarity of illustration, it is clearly obvious that in practice the presenting device may comprise a substantially greater number of receptacles, possibly up to about a hundred.

Such a distribution of receptacles 18 at the periphery of the drum 11, unlike the spokes of a wheel, enables the bulk of the device to be substantially reduced.

In the embodiment in FIG. 1, the centers of the perforations 17 of the end perforated crown 13 are aligned with the centers of the perforations 17 of the two intermediate crowns 15 and 16 along a generatrix of a cone 19 having the same axis as the drum 11.

Consequently it is then possible to reduce the outer diameters of the different crowns which decrease from that of the unperforated end crown 14 to that of the perforated end crown 13, which facilitates reading of and access to the different receptacles 18 containing the samples to be analyzed.

The half-angle at the summit of the cone 19 formed by these generatrices is preferably between about 5° and 15°.

According to the embodiment shown in FIG. 2, which represents a preferred employment of the invention, the generatrices of the cylinder 20, having the same axis as the drum 11 and passing through the centers 21 of the perforations 17 of the end perforated crown 13, do not coincide with the generatrices of this same cylinder 20 passing through the centers 22 of the perforations 17 of the intermediate crowns 15 and 16.

As a result of the offset between the centers of the perforations of the different crowns, there is a certain angle between the axis 12 of the drum 11 and the alignment of the center 21 of a perforation of the end perforated crown 13 with the center 22 of the perforation 17 of the intermediate crown 15 or 16 closest to the generatrix of the cylinder 20.

This angle which corresponds to the slope of the receptacles 18 relative to the axis of the drum, is preferably between about 5° and 20°.

During use of the device according to the invention in or with an automatic analyzer, the axis 12 of the drum 11 is not, as shown in FIGS. 1 to 3, vertical but horizontal, and the device rotates about this axis to present each of the receptacles 18 to the needle of the system responsible for removing the sample to be analyzed by perforating the stopper closing the receptacle 18.

During this operation, the receptacles 18 perform a rotation of 360° around the axis 12, which agitates the sample to be analyzed.

It should be mentioned that this rotation does not only displace the liquid to be analyzed inside each receptacle 18 as a result of the rotation of the drum around a horizontal axis, but, as shown in the Figures, each receptacle 18, as a result of its slope relative to the axis 12 of the drum, passes successively from a position sloping downwards, where the liquid to be analyzed is in contact with the stopper closing the receptacle 18, to a diametrically opposite position sloping upwards where the liquid is not contact with the stopper.

Such a tipping movement of the sample before analysis, intentionally limited as a result of the low angle of slope of the receptacle relative to the axis 12 of the device, contributes to good homogenization of the product to be analyzed without damage to its constitution and in particular without causing rupture of the cells in the case of analysis of blood.

The device according to the invention is therefore of particular interest for analysis of blood samples involving cell counts.

To prevent any of the receptacles from falling, during the course of the rotation of the device for presentation of receptacles according to the invention, a holding element is provided, especially a friction element, which can in particular take the form of a ring 23, preferably disposed in the perforations 17 of the intermediate crown 15 closest to the unperforated end crown 14.

A simplified embodiment of the invention is shown in FIG. 3 where the presenting device comprises only two circular crowns 13 and 14 disposed at each end of a cylindrical drum 11. The crown 13 is perforated as in FIG. 1, but comprises in each of its perforations 17 an element for holding by friction 23 to retain the receptacles 18. And in order to compensate for the absence of any intermediate perforated crown in this embodiment, the end crown 14 comprises as many cavities 24 adapted to house the ends of the receptacles 18 containing the samples to be analyzed as the crown 13 comprises perforations 17. The centers of the cavities 24 of the crown 14 and the centers of the perforations 17 of the crown 15 are situated on the surface of a cylinder 20 having the same axis as the drum 11 and a larger diameter corresponding to the distance of these centers from the axis 12 of the drum, but these centers are offset in such a way that the receptacles 18 are inclined relative to the axis of the drum at an acute angle, especially between 5° and 20°.

What is claimed is:

1. A device for presentation of receptacles, and especially of assay tubes each containing a sample of liquid to be analyzed, said device comprising a cylindrical rotatable drum having a core and at least two circular crowns which are integral with the core, and one crown being disposed at each end of the drum, at least two of the crowns having the same number of receptacle receiving means selected from the group consisting of perforations and cavities distributed all around the respective crown and adapted to receive the receptacles containing the samples, the receptacle receiving means of the crowns being disposed in such a way that an axis of each receptacle when received in the receptacle receiving means is inclined at an acute angle less than 45° relative to an axis of rotation of the drum, wherein, the axis of rotation of the drum is maintained horizontal during the presentation of the receptacles with a view to the transfer, after homogenization, of all or part of their contents into an automatic analyzer.

2. A device according to claim 1, wherein the cylindrical drum further comprises a further intermediate circular crown having the same perforations as an end perforated crown to guide the positioning of each receptacle in the device.

3. A device according to claim 1 wherein, one of said circular crowns is an intermediate crown having perforations therein, a center of each perforation of an end circular perforated crown being aligned with a center of a respective perforation of said perforated intermediate crown along a surface of a cone having an axis common with the axis of the cylindrical drum in a manner to present the containers inclined along said surface of said cone.

4. A device according to claim 3, wherein the outer diameters of the circular crowns fixed to the drum decrease from one end of the drum to the other.

5. A device according to claim 3, wherein the half-angle at a top of said cone, said surface of which passes through the centers of the perforations of the circular crowns and which defines the slope of the receptacles relative to the axis of the drum, is an acute angle less than 45°.

6. A device according to claim 5, wherein the said acute angle is between 5° and 20°.

7. A device according to claim 1, wherein centers of the perforations of said circular crowns are situated on the surface of a cylinder having the same axis as the drum but of larger diameter.

8. A device according to claim 7, wherein said circular crowns include at least one intermediate crown having perforations therein and the centers of the perforations of an end perforated circular crown are not situated on said surface of said cylinder as the centers of the perforations of the at least one intermediate crown.

9. A device according to claim 8, wherein the angle formed between an axis of rotation of the drum and the alignment of the center of a perforation of an end perforated circular crown with the center of the perforation of the at lest one intermediate circular crown closest to said surface of said cylinder passing through the first-mentioned center, the said angle defining the slope of the receptacles relative to the axis of the drum, is an acute angle less than 45°.

10. A device according to claim 9, wherein wherein the said acute angle is between 5° and 20°.

11. A device according to claim 1, further comprising an element for holding the receptacles in the perforations of one or more of said circular crowns.

12. A device according to claim 11, wherein the element holds the receptacles by friction.

13. A device according to claim 11, wherein the element is disposed in the perforations of an intermediate circular crown.

14. A device according to claim 1, wherein one end circular crown comprises as many cavities as the other end circular crown comprises perforations, the cavities being arranged to house the ends of the receptacles and to enable the alignment of these receptacles at an acute angle less than 45° relative to an axis of rotation of the drum.

* * * * *

UNITED STATES PATENT AND TRADEMARK OFFICE

CERTIFICATE OF CORRECTION

PATENT NO. : 5,047,210

DATED : September 10, 1991

INVENTOR(S) : Francois MELET

It is certified that error appears in the above-identified patent and that said Letters Patent is hereby corrected as shown below:

On the title page, Item

[73] Assignee: Delete "Melet Schloesing Laboratories", insert therefor -- Melet Schloesing Labortoires --

[30] Foreign Application Data:
Delete "Dec. 4, 1987", insert therefor -- Dec. 11. 1987 --

Signed and Sealed this

Eleventh Day of May, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,047,210
DATED : September 10, 1991
INVENTOR(S) : Francois Melet

It is certified that error appears in the above-indentified patent and that said Letters Patent is hereby corrected as shown below:

Title page, item [73], Assignee: Delete "Melet Schloesing Labortoires" and insert therefor --Melet Schloesing Laboratoires--.

Title page, item [30], Foreign Application Data: Delete "Dec. 4, 1987, insert therefor-- Dec. 11, 1987 --

This certificate supersedes Certificate of Correction issued May 11, 1993.

Signed and Sealed this

Twenty-eight Day of February, 1995

*Attest:*

Bruce Lehman

BRUCE LEHMAN

*Attesting Officer*

*Commissioner of Patents and Trademarks*